US007242640B2

(12) United States Patent
Fleury

(10) Patent No.: US 7,242,640 B2
(45) Date of Patent: Jul. 10, 2007

(54) ANNUAL DATA MECHANISM FOR A TIMEPIECE MOVEMENT

(75) Inventor: Christian Fleury, Challex (FR)

(73) Assignee: Rolex S.A., Geneva (CH)

( * ) Notice: Subject to any disclaimer, the term of this patent is extended or adjusted under 35 U.S.C. 154(b) by 294 days.

(21) Appl. No.: 11/110,251

(22) Filed: Apr. 20, 2005

(65) Prior Publication Data

US 2005/0254350 A1 Nov. 17, 2005

(30) Foreign Application Priority Data

May 14, 2004 (EP) ..... 04405309

(51) Int. Cl.
*G04B 19/24* (2006.01)

(52) U.S. Cl. ..... 368/38; 368/28; 368/37; 368/221

(58) Field of Classification Search ..... 368/28, 368/34, 35, 36, 37, 38, 39, 77, 220, 221, 368/232, 233
See application file for complete search history.

(56) References Cited

U.S. PATENT DOCUMENTS 4,240,249 A * 12/1980 Malkin et al. ..... 368/28
5,699,321 A * 12/1997 Vaucher ..... 368/37
5,943,299 A * 8/1999 Genta ..... 368/28
6,744,696 B2 * 6/2004 Vernay et al. ..... 368/37

FOREIGN PATENT DOCUMENTS

| | | |
|---|---|---|
| CH | 374336 | 7/1963 |
| CH | 680630 | 10/1992 |
| CH | 685585 | 8/1995 |
| CH | 693691 | 12/2003 |
| EP | 0987609 | 3/2000 |
| EP | 1351104 | 10/2003 |

* cited by examiner

*Primary Examiner*—Vit Miska
*Assistant Examiner*—Jeanne-Marguerite Goodwin
(74) *Attorney, Agent, or Firm*—Sturm & Fix LLP

(57) ABSTRACT

This mechanism comprises a date runner, a months satellite with five teeth on a pitch for twelve, secured to the date runner, a fixed planetary toothset and a drive member for driving the date runner comprising two drive fingers, the first intersecting the path of the toothset of the date runner, the second intersecting the path of the toothset of the months satellite. The latter is connected to the planetary toothset by a second satellite secured to it and the number of teeth of which is equal to a multiple of twelve, the number of teeth of the planetary toothset being chosen so that one of the five teeth of the months satellite is aligned with the axes of the satellites, of the drive member and of the date runner on the 30th of each month comprising less than 31 days.

5 Claims, 4 Drawing Sheets

ANNUAL DATA MECHANISM FOR A TIMEPIECE MOVEMENT

CROSS REFERENCE TO RELATED APPLICATIONS

This application claims priority of European Application No. 04405309.8 filed May 14, 2004, and is included herein in its entirety by reference made hereto.

BACKGROUND OF THE INVENTION

1. Field of the Invention

The present invention relates to an annual date mechanism for a timepiece movement comprising a 31-toothed date runner, a jumper in mesh with its toothset, a months satellite, the rotation pin of which is secured to this date runner and which comprises five driving teeth of a toothset on a pitch for twelve for the months comprising less than 31 days, a fixed planetary toothset coaxial with the date runner and in a direct-drive relationship with the months satellite and a drive member for driving the date runner in a driving relationship with the hours wheel of the timepiece movement and comprising two drive fingers, the first intersecting the path of the toothset of the date runner, the second intersecting the path of the toothset of the months satellite when its axis of revolution is aligned with those of the planetary toothset, of the drive member and of the date runner.

2. Description of Related Art

Such an annual date mechanism, associated with a perpetual calendar mechanism, is described in EP 1 351 104. This mechanism comprises a months satellite the pivot pin of which is secured to a date wheel which makes one revolution per month. This months satellite has twelve teeth, seven of which are truncated and five of which are not. The twelve teeth of this satellite mesh with a fixed 7-tooth planetary toothset coaxial with the date wheel.

During the year, for each revolution of the date wheel, the toothset of the months satellite occupies a different position when its axis of pivoting is aligned with the axis of the planetary toothset and the axis of pivoting of a wheel which makes one revolution every twenty-four hours in order to drive the date wheel. For this purpose, this twenty-four hour wheel has twenty-four teeth, twenty of which are truncated and of the other four, one is a normal drive tooth which meshes with the date wheel once per day and another is an annual correction tooth, offset parallel with its axis of rotation, to come into mesh with one of the five un-truncated teeth of the months satellite each time the month contains less than thirty-one days.

When the month comprises less than 31 days, one of the five un-truncated teeth of the months satellite covers one of the teeth of the data wheel and is situated in the path of a correcting tooth of the wheel which makes one revolution in twenty-four hours so that by turning, the correction tooth of this wheel, offset parallel to its axis of rotation, causes the months satellite to turn, which satellite, being in mesh with the fixed planetary toothset, causes the date wheel to turn before the normal driving finger driving this twenty-four hour wheel causes the date wheel to turn by one step, as it does on each rotation, so that the date wheel is moved by two steps for one revolution of the twenty-four-hour wheel.

This mechanism has the advantage of avoiding the cams and lever devices like those described in CH 685 585 or in EP 987 609, which use energy, are tricky to develop and are therefore not very reliable.

Although the design is tempting, this mechanism does, however, exhibit a substantial disadvantage stemming from the fact that the months satellite works on a first pitch circle with the fixed planetary toothset, whereas it works on a second pitch circle, larger than the first, with the drive teeth of the twenty-four hour wheel. This larger pitch diameter is needed to prevent the drive teeth of the twenty-four hour wheel from being able to mesh with the truncated teeth of the months satellite. In consequence, the penetration between the teeth of the twenty-four hour wheel in the toothset of the months satellite is shallow, and the magnitude of the drive angle is small. Such a mechanism is not therefore very reliable and at the very least is extremely difficult to optimize, leading to item by item readjustment.

An additional disadvantage with this solution stems from the fact that when the axis of revolution of the months satellite is aligned with the respective axes of revolution of the planetary toothset and of the twenty-four hour wheel, the satellite lies between them, which means that this satellite is driven on part of its toothset situated furthest from the center of the date wheel by the twenty-four-hour wheel situated on the outside of this date wheel, reducing the drive angle to a minimum, the penetration and the drive angle already being small because the pitch diameter between this twenty-four-hour wheel and the months satellite is enlarged with respect to the pitch diameter between this satellite and the planetary toothset. Production and development of such a mechanism is therefore problematic and its reliability is poor.

It can therefore be concluded from this that, in spite of there being a solution which is the subject of EP 1 351 104, no credible alternative to the current date mechanisms that employ cams and levers has yet been proposed.

BRIEF SUMMARY OF THE INVENTION

The object of the present invention is to remedy, at least in part, the aforesaid disadvantages.

To this end, the subject of the present invention is a date mechanism as claimed in claim 1.

The essential advantage of this invention stems from the fact that the presence of two coaxial satellites, each of which performs a separate function, allows each of them to work with normal toothsets, each toothset working only over one single pitch circle, the respective pitch circles of the two runners meshing with one another being tangential. These conditions of meshing allow the toothsets to have optimum penetrations, therefore drive angles able to produce a reliable drive, something which is not the case when working near the tip of the teeth.

The design of an annual date mechanism with no rockers or levers, with optimum penetrations and drive angles according to the present invention, makes any adjustment of this mechanism superfluous. This is an important reliability factor insofar as, on the one hand, any adjustment will involve a tolerance margin and, on the other hand, any adjustment is liable to become unset. The instantaneous jump rocker used with the preferred form of instantaneous change of the date does not come into consideration because it does not contribute to the correcting of the number of days in the month in the annual date mechanism according to the invention but is used only to deliver stored-up energy in order to instantaneously drive the date runner.

Advantageously, the axis of revolution of the drive member driving the date runner, when aligned with the respective axes of revolution of the satellites and of the planetary toothset, lies between their axes of revolution.

By virtue of this feature, the drive angle can be further improved.

As a preference, the second satellite has a diameter appreciably larger than that of the months satellite. As a result, the drive of the months satellite by the correcting finger is performed on a pitch radius that is smaller than that of the second satellite. Thanks to this special feature, the direction of rotation of the satellites when driven by the second drive finger is the same as that of the drive member bearing said second finger.

Through this mode of driving that can be termed "pseudo-paradoxal", the drive angle and therefore the security of the mechanism can be further increased.

As a preference, the date runner bearing the months satellite is a date annulus or date disk coaxial with the center of the timepiece movement, thus making it possible to have components of larger dimensions than can be had with an offset mechanism. Furthermore, the arrangement of the satellites on the date runner makes it possible to reduce the number of components, no intermediate transmission member being needed between the annual date mechanism and the date runner.

The reliability of this mechanism, which uses only gearing, with good penetration of their toothsets and drive angles capable of ensuring correct operation of the date runner, lends itself particularly well to being driven by an instantaneous-jump drive mechanism. Advantageously, in this case, the date runner has the shape of an annulus.

BRIEF DESCRIPTION OF THE DRAWINGS

The attached drawings illustrate, schematically and by way of example, one embodiment of the date mechanism that is the subject of the present invention.

DETAILED DESCRIPTION OF THE INVENTION

Figure 1:
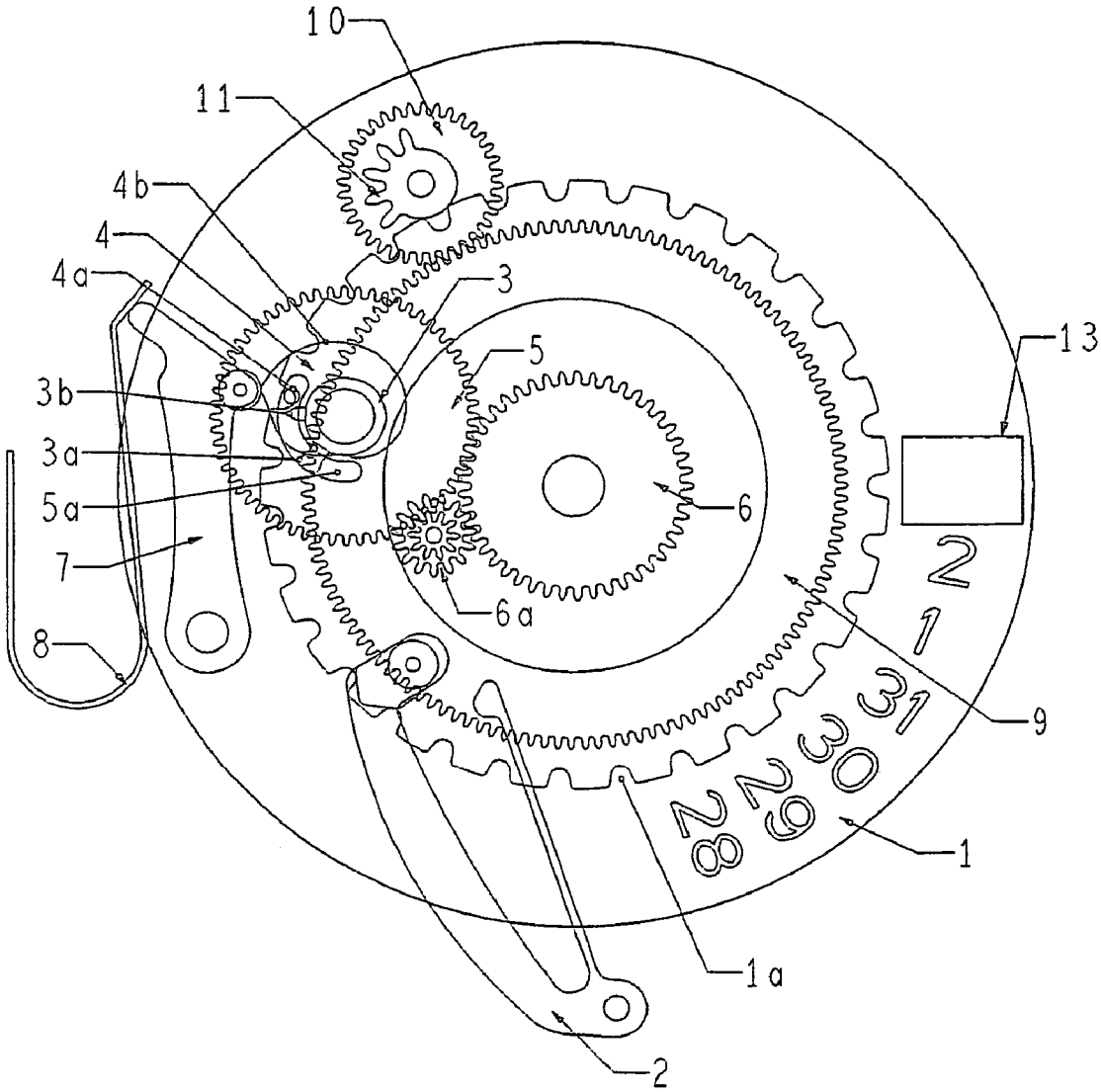
FIG. 1 is a plan view of this embodiment showing all its components.

The date mechanism that is the subject of the invention comprises a date runner, preferably in the form of a date annulus 1, also known as a date disk. The internal edge of this date annulus 1 has 31 teeth positioned by a jumper spring 2. The daily drive of this date annulus is performed by a driving finger 3*a* secured to a drive member 3 secured to an instantaneous jump cam 4 connected to a wheel 5 via a pin 4*a* in mesh with an opening 5*a* in the shape of an arc of a circle formed in the wheel 5. This wheel 5 is driven at the rate of one revolution every twenty-four hours by the hours wheel 6 of the timepiece movement and via a runner 6*a*.

A rocker 7 is pressed against the periphery of the instantaneous jump cam 4 by a spring 8 intended to cause the cam 4 to turn abruptly in the clockwise direction as soon as it reaches the end of the spring 8 arming ramp 4*b* so as to drive the drive member 3 that drives the date annulus 1.

That which has just been described corresponds to a simple instantaneous date mechanism in which the date annulus 1 is driven by one step every twenty-four hours, which means that a correction needs to be made five times per year at the end of the months comprising less than thirty-one days.

We shall now describe the components that make it possible to progress from the simple date described hereinabove to an annual date. For this, a planetary toothset 9 is fixed to the housing of the timepiece movement, concentric with the date annulus 1. A satellite pinion 10, the number of teeth of which is twelve or, preferably, a multiple of twelve is mounted to pivot about a pin secured to the date annulus 1. This satellite pinion 10 is constantly in mesh with the planetary toothset 9, forming with the latter a simple epicyclic gearset which makes one revolution per month. A second months satellite pinion 11 having just five teeth out of twelve is secured to and coaxial with the satellite pinion 10. As a preference, the diameter of the months satellite pinion 11 is smaller than that of the satellite pinion 10.

Finally, the drive member 3 bears a second finger 3*b*, offset, both angularly forwards relative to the clockwise direction of rotation of this drive member 3 and parallel to its axis of rotation. This second finger 3*b* of the drive member 3 constitutes a correcting finger intended to drive the date annulus 1 by one additional step at the end of each month comprising less than 31 days.

Figure 2A:
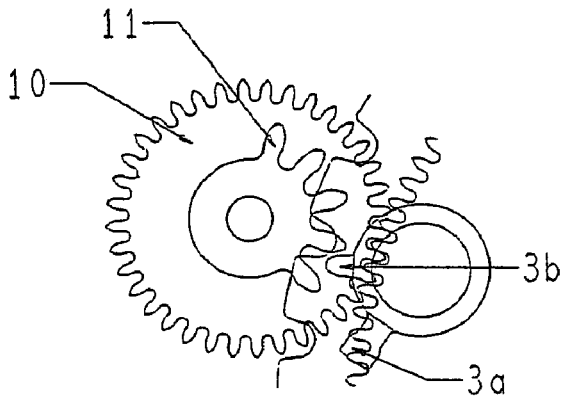
FIG. 2A is an enlarged partial view of a portion indicated by a circle A in chain line, in FIG. 2.
Figure 2:
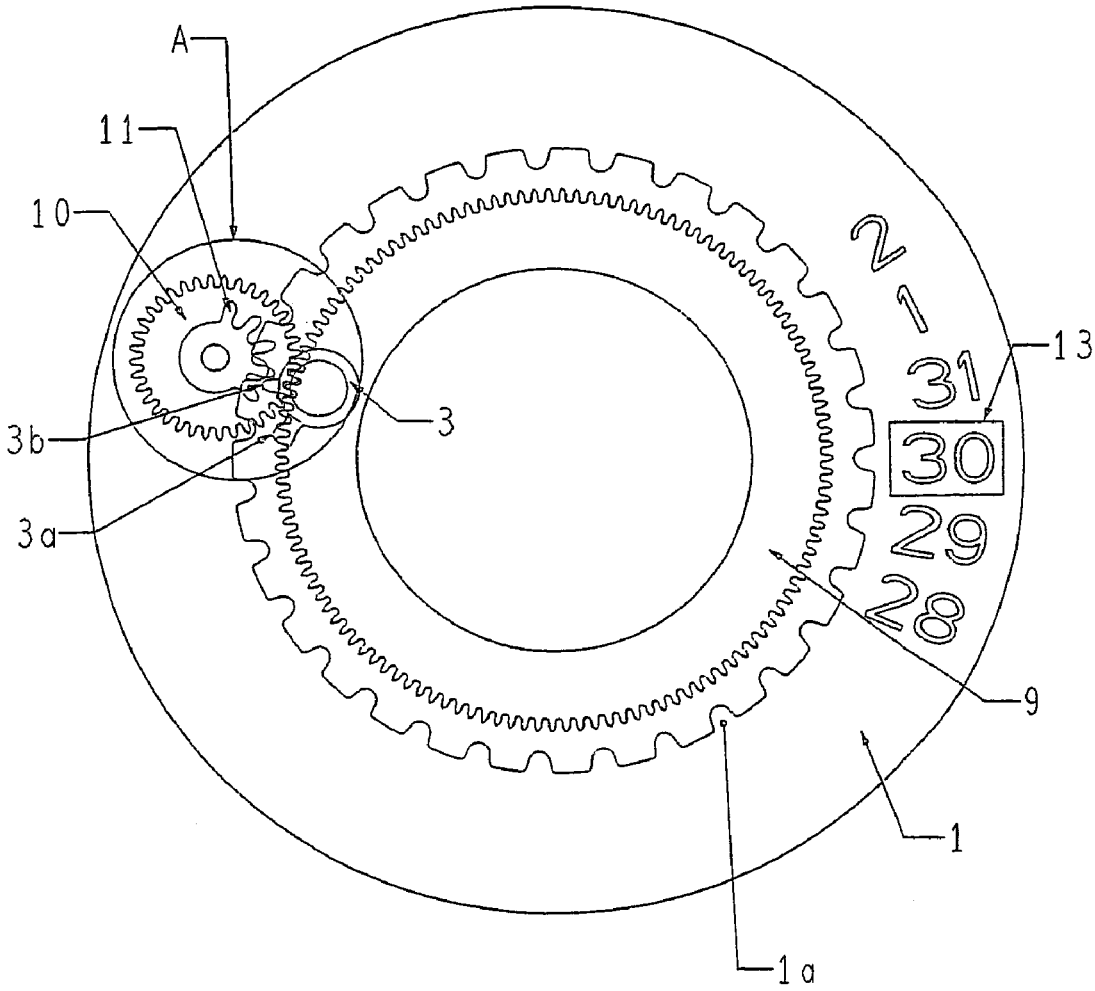
FIG. 2 is a partial and simplified view of FIG. 1, showing the position of the various components on November 30.

The principle on which the correction mechanism operates is that of, on the 30th of each month comprising less than 31 days, bringing one of the five teeth of the months satellite pinion 11 substantially into alignment with the straight line connecting the respective axes of revolution of the planetary 9, of the drive member 3 driving the date runner 1 and of the satellites 10, 11, as illustrated in FIG. 2.

As soon as the rocker 7 passes beyond the end of the arming curve 4*b* of the instantaneous-jump cam 4, it causes this cam 4, and the drive member 3 secured to it, to turn abruptly in the clockwise direction. This abrupt rotation of the cam 4 is rendered possible by the circular-arc-shaped opening 5*a* in which the pin 4*a* of the cam 4 is engaged. During this movement, the correcting finger 3*b* which is in contact with one of the five teeth of the months satellite pinion 11 is driven. Given that, on the one hand, this satellite 11 is secured to the larger-diameter satellite 10 which is in mesh with the planetary 9 and that, on the other hand, the drive member 3 is situated between the axis of revolution of the planetary 9 and the axis of revolution of the satellites 10, 11, the movement of the satellite 11 by the correcting finger 3*b* results in a rotation of this satellite 11 in the clockwise direction, that is to say in the same direction as the drive member 3. This gearset that can be termed "pseudo-paradoxal" makes it possible to increase the angle of contact between the correcting finger 3*b* and the satellite pinion 11, improving the security of the movement and guaranteeing that the date annulus 1 will not be driven backwards by the jumper 2 but, on the contrary, that the latter will complete the driving of the date annulus by moving it in the clockwise direction.

Figure 3A:
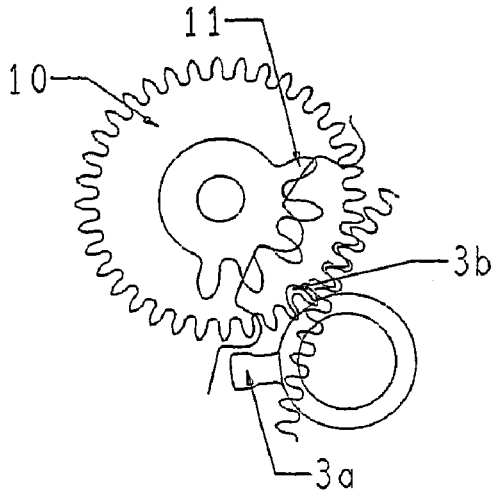
FIG. 3A is an enlarged partial view of a portion indicated by circle A in chain line in FIG. 3.
Figure 3:
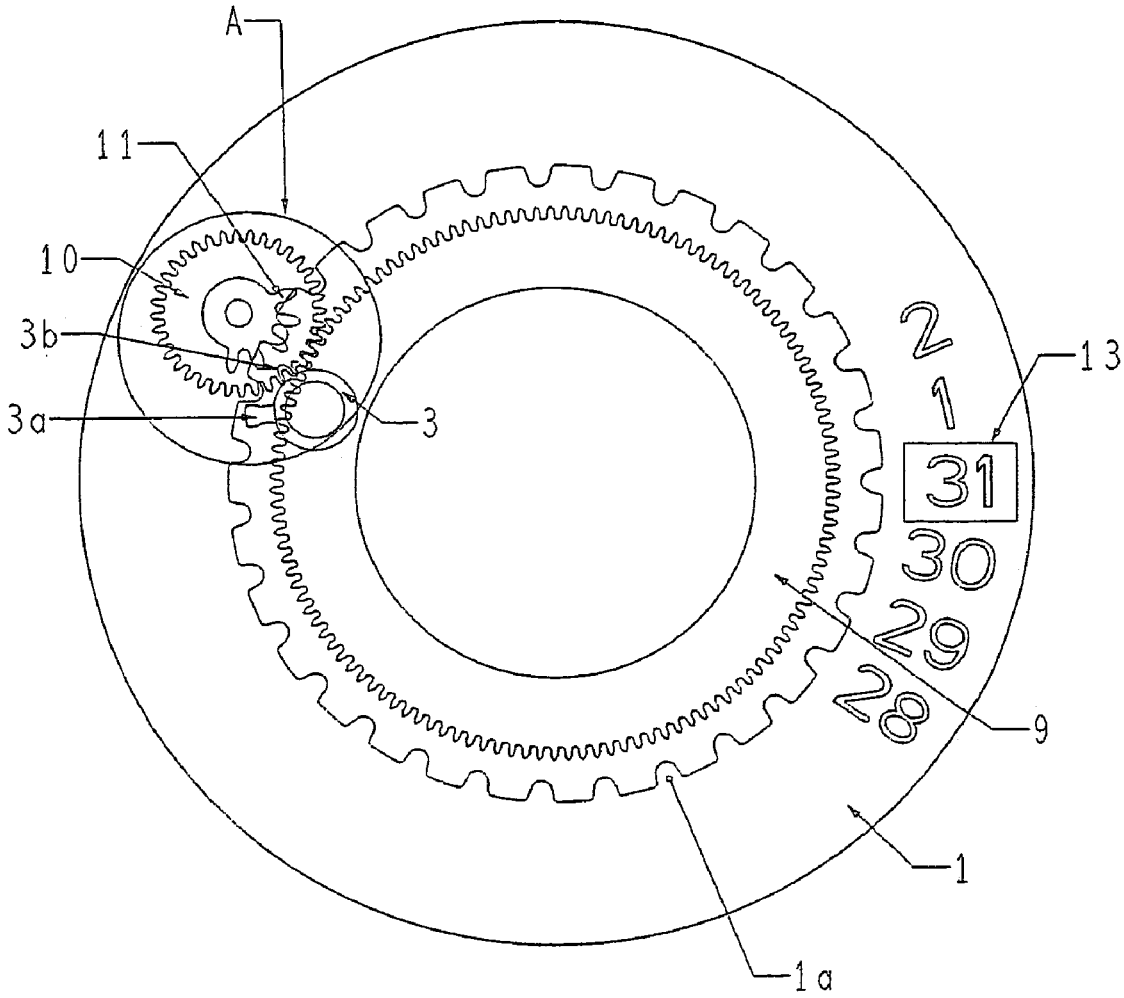
FIG. 3 is a view similar to FIG. 2 showing the position of the components of the mechanism on November 30, after correcting from 30 to 31, but before moving on to December 1.

At the end of this first driving phase, the components of the date mechanism are in the position illustrated in FIG. 3, that is to say that the date annulus 1 has been advanced by one step to 31. During the second phase it is the normal driving finger 3*a* which takes over and moves the disk as it does every twenty-four hours, to bring the "1" for the next month into the window 13 the position of which is indicated in chain line.

Obviously, the two phases of driving the date annulus which have just been described follow on from one another without interruption, in the same angular movement of the instantaneous-jump cam 4, the total duration of driving being merely a few hundredths of a second, and therefore imperceptible to the naked eye.

In order for the five teeth of the satellite pinion 11 to be arranged in the correct position at the end of each month depending on the number of days in the month, it is obviously necessary for the number of revolutions of the satellite per revolution of the date annulus to be a non-integer number. However, this condition is not sufficient.

The first condition to be satisfied is obviously that the satellite 10 which represents the months, should have a number of teeth corresponding to twelve or a multiple of twelve. As regards the months satellite with five teeth distributed on a pinion with a pitch designed to have twelve, its five teeth need to be either arranged on five consecutive pitch steps, or arranged chronologically, in the same order as the months comprising under thirty-one days succeed the months comprising thirty-one days, or in the reverse chronological order.

It has been possible to establish, empirically, a formula for calculating the number of teeth on the planetary 9 capable of bringing one of the five teeth of the satellite pinion into alignment with the respective axes of revolution of the satellites 10, 11, of the drive member 3 driving the date runner 1 and of the planetary 9, on the 30th of each of the months comprising less than thirty-one days. This condition is satisfied for all the numbers or multiples thereof obtained using the following formula:

$$z_{i+1}=z_i+3+(-1)^i, \text{ with } i=1, 2, 3, \ldots, \text{ and } z_1=5$$

In order to guarantee the most precise possible angular positioning of the months satellite 1 with respect to the correcting finger 3*b*, the numbers of respective teeth on the satellite 10 and on the planetary 9 are chosen to be as large as possible, making it possible to reduce the angular lash of the satellite pinion 10 and therefore that of the five-toothed months satellite pinion 11. In the example described, the planetary has 123 teeth whereas the satellite pinion 10 has 36.

Depending on the number of teeth from the planetary 9, which is chosen using the above formula, the five teeth on the months satellite pinion 11 will need to be distributed, not grouped as in the example depicted but separated by gaps equal to one or two pitch steps, depending on whether the month comprising less than thirty-one days is followed by one or by two thirty-one-day months,.as is the case with June and November. In this case, the number of revolutions of the satellites 10, 11 per revolution of the date runner 1 will be equal either to a number of whole revolutions plus $1/12^{th}$ of a revolution, or to a whole number of revolutions plus $11/12^{th}$ of a revolution, depending on whether five teeth of the satellite pinion follow on in chronological order as per the months of the year or in the reverse order to the months of the year.

Figure 4:
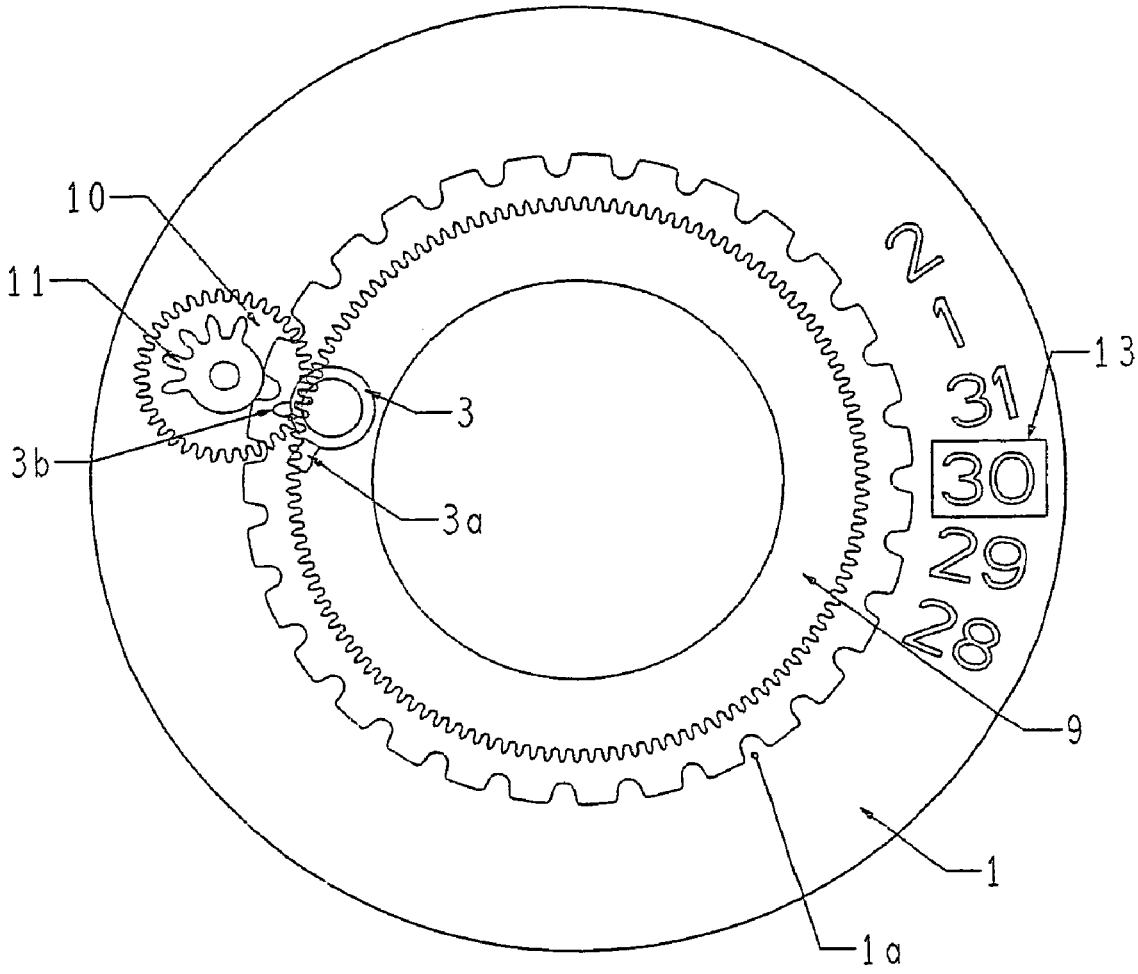
FIG. 4 is a view of the previous figures, showing the position of the components of the mechanism on March 30.

FIG. 4 illustrates the angular position of the five teeth of the months satellite pinion 11 at the end of a thirty-one-day month, in this instance the month of March. It can be seen that none of the five teeth of the satellite pinion 11 lies in the path of the correcting finger 3*b*. In consequence, when the instantaneous jump rocker 7 causes the fingers 3*a* and 3*b* to turn by way of the cam 4, the finger 3*b* will not encounter a tooth of the satellite pinion 11 and only the finger 3*a* will drive the date annulus 1 by one step, bringing "31" into the window 13.

The invention claimed is:

1. An annual date mechanism for a timepiece movement comprising a 31-toothed date runner, a jumper in mesh with its toothset, a months satellite, the rotation pin of which is secured to this date runner and which comprises five driving teeth of a toothset on a pitch designed for twelve for the months comprising less than 31 days, a fixed planetary toothset coaxial with the date runner and in a direct-drive relationship with the months satellite and a drive member for driving the date runner in a driving relationship with the hours wheel of the timepiece movement and comprising two drive fingers, the first intersecting the path of the toothset of the date runner, the second intersecting the path of the toothset of the months satellite when its axis of revolution is aligned with those of the planetary toothset, of the drive member and of the date runner, wherein the months satellite is connected to the planetary toothset by a second satellite which is secured to it and coaxial and the number of teeth of which is equal to a multiple of twelve, and the toothset of each of said satellites works on a pitch circle tangential to the pitch circle of the toothset with which it is in mesh, the number of teeth $z_i$ of the planetary toothset being chosen from numbers or multiples of numbers obtained according to the formula:

$$z_{i+1}=z_i+3+(-1)^i, \text{ with } i=1, 2, 3, \ldots, \text{ and } z_1=5$$

so that each revolution of the date runner corresponds to a non-integer number of revolutions of the satellites such that one of the five teeth of the months satellite is more or less aligned with the axes of the satellites, of the planetary toothset and of the drive member driving the date runner on the 30th of each month comprising less than 31 days so as to allow said second finger to drive the date runner by an additional step via said satellites.

2. The date mechanism as claimed in claim 1, in which the axis of revolution of the drive member driving the date runner, when aligned with the respective axes of revolution of the satellites and of the planetary toothset, lies between their axes of revolution.

3. The date mechanism as claimed in claim 1, in which the second satellite has a diameter appreciably larger than that of the months satellite so that the direction of rotation of satellites when they are being driven by the second drive finger is the same as that of the drive member bearing said second finger.

4. The date mechanism as claimed in claim 1, in which the date runner is an annulus with an internal toothset.

5. The date mechanism as claimed in claim 1, in which said drive member is connected to the hours wheel of the timepiece movement by an instantaneous-drive device.

* * * * *